US005372423A

United States Patent [19]

Torredeflot

[11] Patent Number: 5,372,423

[45] Date of Patent: Dec. 13, 1994

[54] DEVICE FOR MIXING PULVERULENT MATERIAL INTO A LIQUID

[76] Inventor: Antonio R. Torredeflot, C/ Gomis,1 & 22, 08023 Barcelona, Spain

[21] Appl. No.: 74,600

[22] Filed: Jun. 11, 1993

[51] Int. Cl.[5] ..... B01F 15/02

[52] U.S. Cl. ..... 366/156; 241/82.4; 241/82.5; 366/176

[58] Field of Search ..... 366/303, 176, 156, 157, 366/307, 302, 303; 241/82.4, 82.5

[56] References Cited

U.S. PATENT DOCUMENTS 2,092,992 9/1937 Thalman ..... 241/82.4
2,960,318 11/1960 Caillaud ..... 366/303
3,366,368 1/1968 Hibbing ..... 366/176
4,512,523 4/1985 Higashimoto ..... 241/82.5

*Primary Examiner*—Robert W. Jenkins
*Attorney, Agent, or Firm*—Oliff & Berridge

[57] ABSTRACT

A device for mixing pulverulent material into liquids is described. A mixing body receives pulverulent material at an upper opening and liquids at a tangential opening. A motor-driven screw in a hopper containing the pulverulent material advances the pulverulent material to the upper opening. To avoid lumping of the pulverulent product, a motor-driven agitator is disposed within the hopper. The mixer body includes a driven shaft which drives several turbines. Grooved plates are provided between the turbines to cause abrupt changes in the direction of the mixture flow.

21 Claims, 4 Drawing Sheets

DEVICE FOR MIXING PULVERULENT MATERIAL INTO A LIQUID

FIELD OF THE INVENTION

The present invention relates to devices for mixing a pulverulent product into a liquid.

BACKGROUND OF THE INVENTION

At present, this type of mixing is done with mixing machines having large diameter components, necessitating high-powered motors to obtain adequate flow of the mixture. Combination mixing-grinding machines are also used, which agitate the mixture but cause breaking and grinding of the solid particles of the mixture. This is not beneficial when mixing a liquid with a pulverulent product having grains of a required size.

Another problem with these machines lies in the feeding of the pulverulent product into the mixing chamber. Powder product tends to thicken, especially under conditions of high humidity, resulting in a mixture with variable proportions of powder and liquid.

These machines also have a tendency to incorporate air together with the pulverulent material, forming foam in the tanks and causing a very serious problem in industry.

SUMMARY OF THE INVENTION

In order to solve these problems, the invention incorporates a mixing body with an upper opening for the pulverulent product to enter, and a tangential opening for the entrance of liquids. Feeding of the pulverulent product is carried out by a screw which is activated by a motor element positioned in the lower area of a hopper. In order to avoid thickening of the pulverulent product inside the hopper, an agitator has been provided, activated by a driving element. The hopper also incorporates lead level detectors, and, on one of its sides, an inspection cap which allows adding other miner products to the pulverulent product. The screw advances the product contained in the hopper towards the entrance opening of the mixing body, thus continuously supplying with product and avoiding the entrance of air with the material.

In the central area of the mixing body, which is arranged horizontally, various turbines are mounted on a driving axle. The first turbine includes an inlet which accelerates the initial mixture, composed of the pulverulent product and the liquid, thus originating a helicoidal flow. A number of grooved plates between the other two consecutive turbines cause sudden changes in the direction of the flow of the mixture. This results in the dispersion of the pulverulent product in the liquid, breaking up groupings of grains which form when the product contacts the liquid. These sudden changes in the direction of flow of the mixture cause a suitable dispersion or dissolution of the pulverulent material without grinding or breaking the grains.

The fixed plates between the turbines define a number of straight, slightly slanted grooves extending in a radial direction, which produce the sudden changes in the direction, without causing a reduction in the flow.

The mixture exits from the mixing body once the pulverulent product has been integrated with the liquid.

With this device, which has practically no braking effect on the flow of the mixture, it is possible to use a smaller motor than presently used in mixers, thus obtaining a high quality mixture and greater work efficiency.

DETAILED DESCRIPTION OF THE PREFERRED EMBODIMENTS

Figure 1:
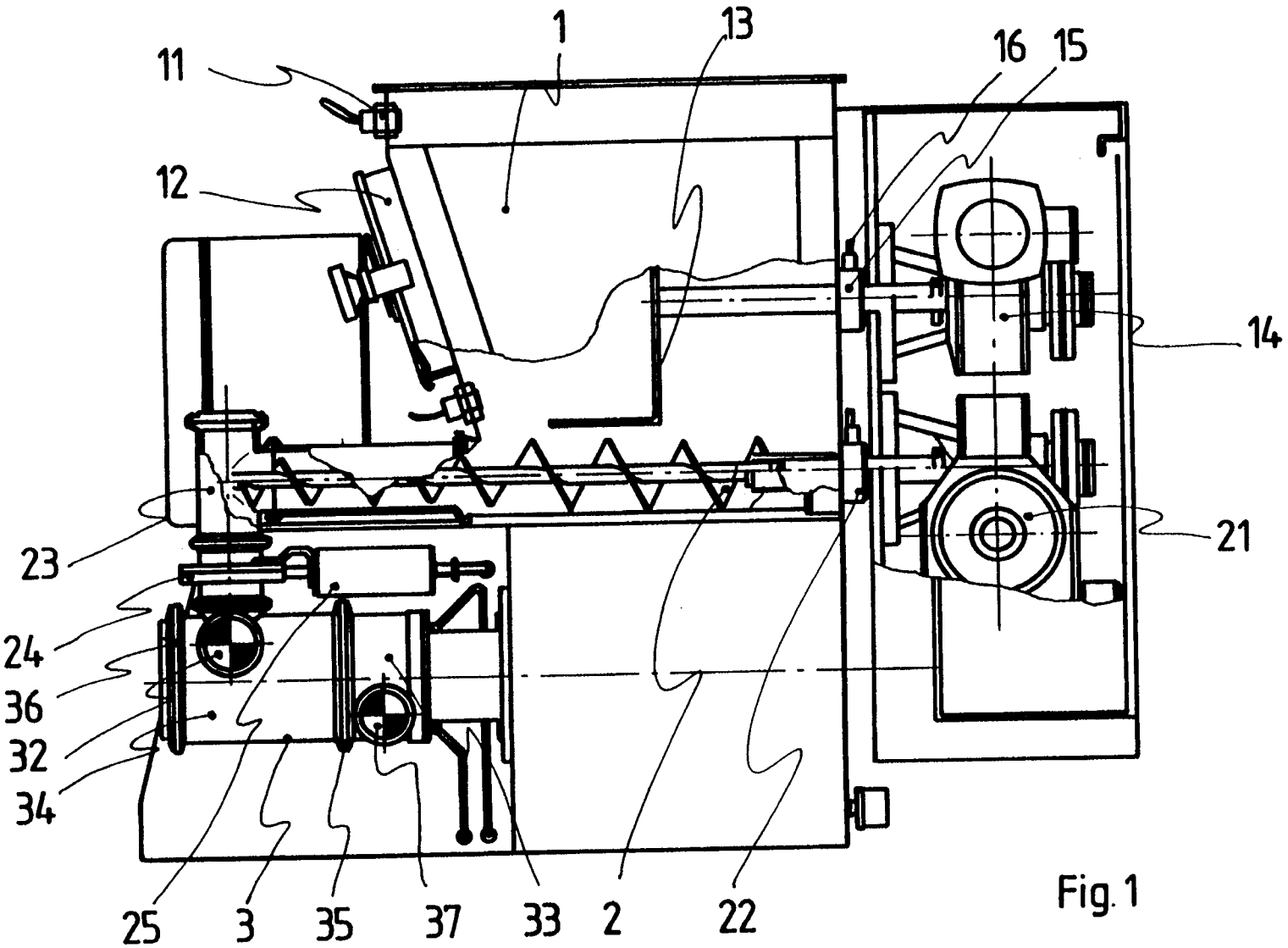
FIG. 1 shows a partial sectional view of the machine.

The mixer of this invention includes a hopper 1 with level detectors 11 close to its upper and lower ends, and an inspection cap 12 at one of its sides. Minor products can be added through cap 12 to the pulverulent product, such as powder, contained in the hopper 1. Motor 14 drives agitator 13, the motor axle extending into hopper 1 through pressurized valve 15. A pressurized air hose may be connected to valve inlet 16. Valve 15 prevents the pulverulent product in the hopper from exiting through the hole in the hopper wall for the axle.

In the lower part of the hopper 1 a screw 2 is fixed to the axle of motor 21, which is outside the hopper. Pressurized valve 22 is analogous to valve 15. Screw 2 shifts the product to a vertical pipe 23, in which is disposed a stop-valve 24 actuated by a preferably pneumatic cylinder 25.

Mixing body 3 lies below hopper 1. Pulverulent material passes from vertical pipe 23 into mixing body 3 through inlet 31. Tangential inlet 32, connected to a suitable pipeline, introduces liquid into the mixing body 3 for mixing with the pulverulent product. Outlet 37, connected to a suitable pipeline, allows the pulverulent-liquid mixture to exit mixing body 3.

Mixing body 3 is composed of two cylindrical elements 33, 34 joined together by a tightener formed by a peripheral belt acting at the ends of the cylindrical elements. Belt 35 allows disassembly of the cylindrical elements, providing easy access to the mixture. Cylindrical element 34 is closed at its free end by a cap 36, which includes a transparent portion.

Inside mixing body 3 is a transmission-driven central axle 4 upon which an entrance turbine 41, an intermediate turbine 42, and an exit turbine 43 are situated.

The entrance turbine 41 includes inlet 44, which accelerates the pulverulent product entering through inlet 31 and the fluid entering through inlet 32. Turbine 41 defines a plurality of helicoidal blades, drawing the pulverulent product and liquid from their respective inlets.

Figure 3:
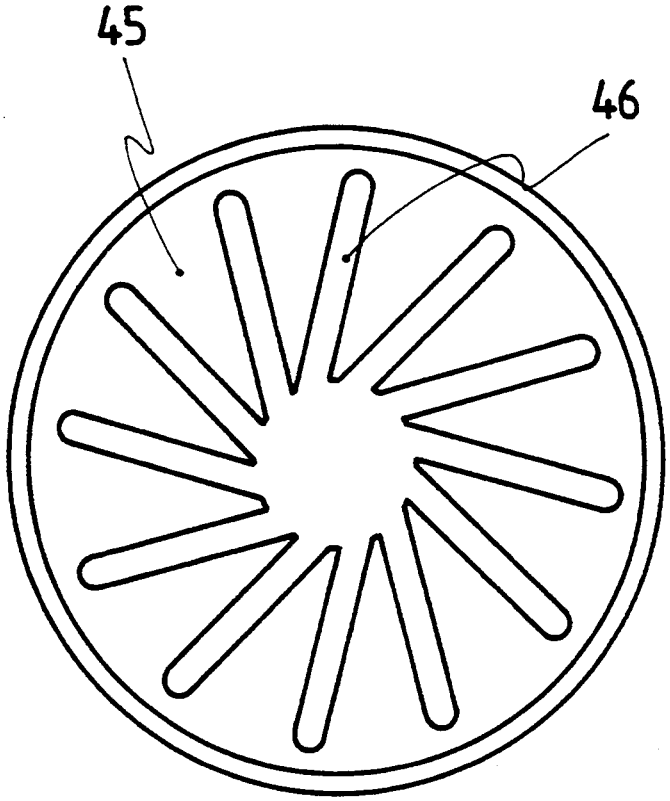
FIG. 3 shows a view of one of the grooved plates.
Figure 4:
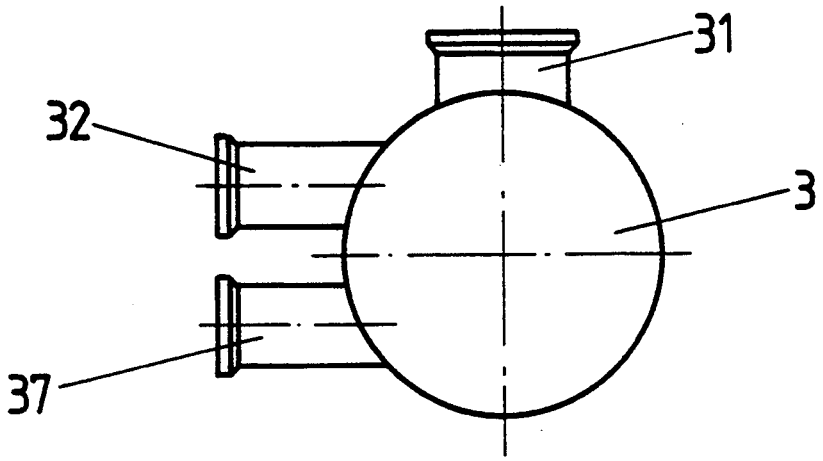
FIG. 4 shows a partial end view of the mixing body.

The flow passes from turbine 41 through a plate 45 between the turbines 41 and 42. This plate defines a number of grooves 46, slightly slanted in a radial direction, as shown in FIG. 3. Plate 45 causes a sudden change in flow direction, breaking up any possible clots formed by the pulverulent product entering into contact with the liquid.

As the flow leaves plate 45 it enters turbine 42. Turbine 42 defines a plurality of blades that define at their periphery a central cut to promote mixture homogeneity. Turbine 42, defining a reduction in diameter, is capable of choking the flow and of hindering the flow of turbulence-causing materials within the flow.

Turbine 42 feeds the mixture to a second plate 47. Plate 47 is analogous to plate 45 but has grooves of a lesser amplitude than those of plate 45. Plate 47 causes another sudden change in the direction of flow to enhance the mixing process.

As the flow leaves plate 47 it enters exit turbine 43. The blades of exit turbine 43 are slightly larger than those of turbine 42 and also include an intermediate peripheral cut. Turbine 43 is also capable of choking the flow and of hindering the flow of turbulence-causing materials within the flow. Turbine 43 completes the blending process, the final mixture being emitted from mixing body 3 at tangential outlet 37.

Figure 2:
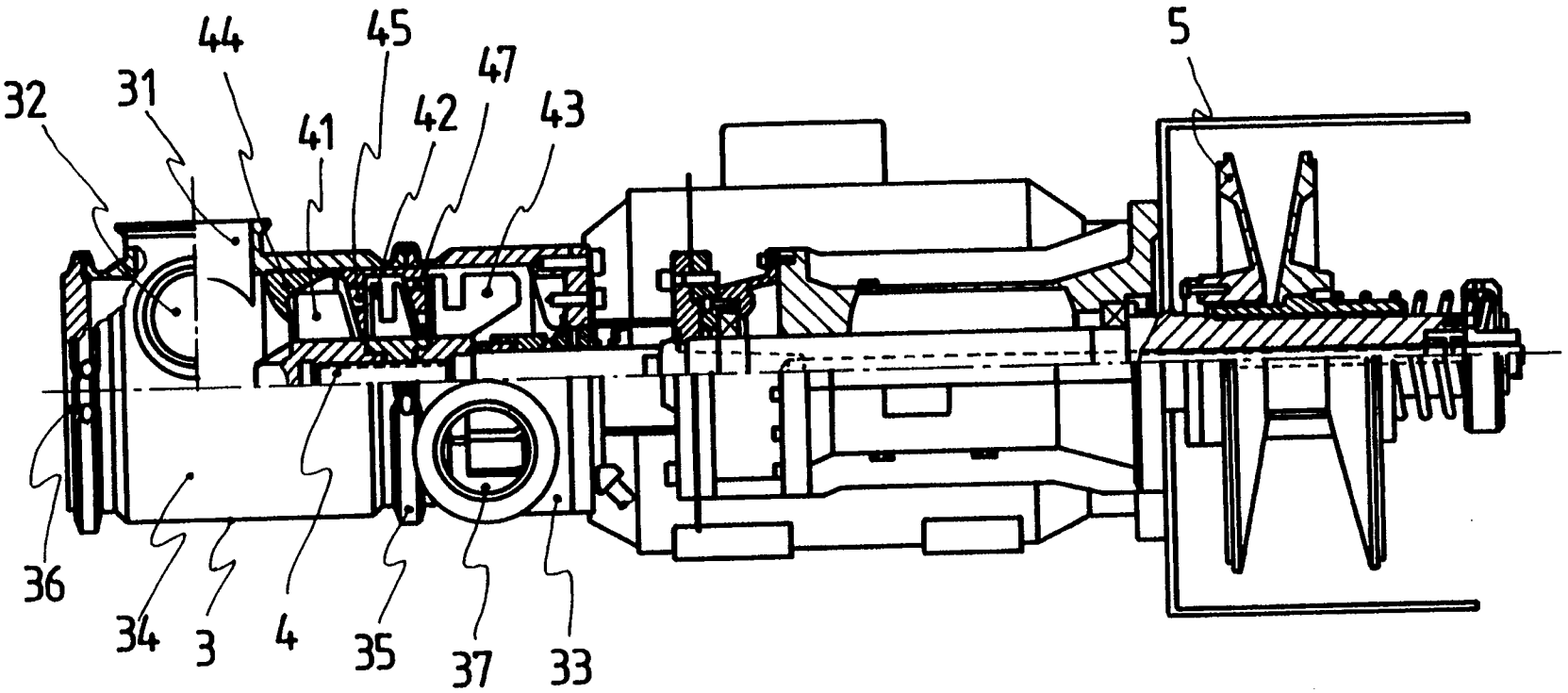
FIG. 2 shows a portion of the machine, including the mixing body.
Figure 5:
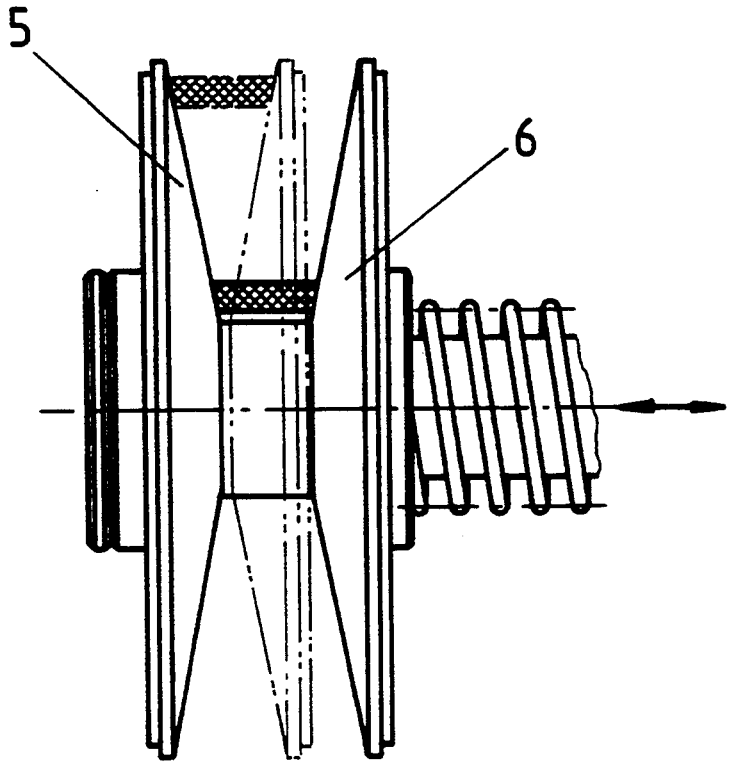
FIG. 5 shows a side view of the speed shifter pulley arrangement.

The turbine axle drive comprises a speed shifted pulley arrangement which includes two facing truncoconical plates, as shown in FIGS. 2 and 5. Fixed plate faces a horizontally displaceable spring-biased plate 6. Drive belt 7 resting on the pulley is of constant width. Shifting the displaceable plate 6 toward and away from the fixed plate 5 respectively increases and decreases the distance between the belt 7 and the pulley shaft, changing the shaft's rotational velocity.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

What is claimed is:

1. Device for mixing pulverulent material into a liquid, comprising:

a hopper for holding the pulverulent material;

a motor-driven screw disposed in a lower portion of the hopper for advancing the pulverulent material; and a mixing body , comprising:

a first inlet for entrance of the pulverulent material received from the hopper;

a second inlet for entrance of liquid;

at least two turbines for receiving pulverulent material and the liquid from the first and second inlets; and at least one static plate located between the at least two turbines.

2. The device of claim 1, wherein the hopper includes upper and lower level sensors for detecting the level of the pulverulent material.

3. The device of claim 1, wherein the hopper includes an inspection cap.

4. The device of claim 1, further comprising a valve which stops the flow of pulverulent material to the first inlet.

5. The device of claim 4, wherein the valve is actuated by a fluid-operated cylinder.

6. The device of claim 1, wherein the mixing body comprises cylindrical elements joined together end-to-end by a belt.

7. The device of claim 1, wherein an anterior chamber of the mixing body includes a cap.

8. The device of claim 7, wherein the cap includes a transparent portion.

9. The device of claim 1, wherein the at least two turbines comprise an entrance turbine, an intermediate turbine, and an exit turbine.

10. The device of claim 9, wherein the at least one plate comprises first and second plates, the first plate being disposed between the entrance and intermediate turbines, and the second plate being disposed between the intermediate and exit turbines.

11. The device of claim 10, wherein the first and second plates include grooves, the grooves of the first plate being larger than the grooves of the second plate.

12. The device of claim 10, wherein the first and second plates include grooves which are angled with respect to a radial direction of the plates.

13. The device of claim 9, wherein the intermediate and exit turbines are capable of hindering the flow of turbulence-causing materials.

14. The device of claim 1, wherein the at least one plate includes grooves which are angled with respect to a radial direction of the at least one plate.

15. The device of claim 1, wherein one of the at least two turbines is an entrance turbine with an inlet serving to accelerate the pulverulent product and liquid.

16. The device of claim 1, further comprising a motor-driven agitator disposed within the hopper.

17. A mixing body of substantially horizontal configuration, comprising:

a first inlet for entrance of pulverulent material;

a second inlet for entrance of liquid;

at least two turbines for receiving the pulverulent material and the liquid from the first and second inlets; and at least one static plate located between the at least two turbines;

wherein the pulverulent material and the liquid travel in a flow direction from the first and second inlets toward the at least one plate; and wherein the at least one plate includes grooves, the grooves as viewed in the flow direction being elongated and angled with respect to a radial direction of the at least one plate, to promote mixing Of the pulverent material into the liquid.

18. The mixing body of claim 17, wherein the at least two turbines comprise an entrance turbine, an intermediate turbine, and an exit turbine, and wherein the at least one plate comprises first and second plates, the first plate being disposed between the entrance and intermediate turbines, and the second plate being disposed between the intermediate and exit turbines.

19. The mixing body of claim 17, wherein the grooves extend through the plate in a direction parallel to the flow direction.

20. Device for mixing pulverulent material into a liquid, comprising:

a hopper for holding the pulverulent material;

a motor-driven agitator disposed in the hopper;

a motor-driven screw disposed in a lower portion of the hopper for moving the pulverulent material;

a mixing body of horizontal cylindrical configuration, comprising:

an entrance turbine, intermediate turbine, and exit turbine provided on a motor-driven central axle;

an anterior chamber with an upper hole for receiving pulverulent material from the motor-driven screw;

a tangential hole for introducing liquid to the mixing body;

a tangential hole for emitting mixed pulverulent material and liquid; and a static, grooved plate disposed between two of the turbines; and a valve which stops the flow of pulverulent material to the upper hole.

21. The device of claim 20, wherein said two of the turbines comprise turbine blades, and wherein the grooved plate and the blades of at least one of said two of the turbines face each other and are spaced apart.

* * * * *